US009302365B2

(12) United States Patent
Valentini

(10) Patent No.: US 9,302,365 B2
(45) Date of Patent: Apr. 5, 2016

(54) DOUBLE SUCTION CHAMBER PLATE

(76) Inventor: Guido Valentini, Milan (IT)

( * ) Notice: Subject to any disclaimer, the term of this patent is extended or adjusted under 35 U.S.C. 154(b) by 128 days.

(21) Appl. No.: 13/558,559

(22) Filed: Jul. 26, 2012

(65) Prior Publication Data

US 2013/0029571 A1 Jan. 31, 2013

(30) Foreign Application Priority Data

Jul. 29, 2011 (IT) ..... MI2011A1434

(51) Int. Cl.
*B24B 55/10* (2006.01)
*B24B 23/02* (2006.01)
*B24D 9/08* (2006.01)

(52) U.S. Cl.
CPC ..... *B24B 23/02* (2013.01); *B24B 55/102* (2013.01); *B24D 9/08* (2013.01)

(58) Field of Classification Search
CPC .... B24B 55/102; B24B 55/05; B24B 55/052; B24B 55/10; B24B 55/02
USPC ..... 451/456
See application file for complete search history.

(56) References Cited

U.S. PATENT DOCUMENTS 3,974,598 A * 8/1976 Guidry ..... 451/490
4,058,936 A * 11/1977 Marton ..... 451/359
5,609,516 A * 3/1997 Courson et al. ..... 451/456
5,713,785 A * 2/1998 Nishio ..... 451/451
6,027,399 A * 2/2000 Stewart ..... 451/353
6,139,411 A * 10/2000 Everts et al. ..... 451/359
6,224,471 B1 * 5/2001 Clowers et al. ..... 451/359
6,616,518 B2 * 9/2003 Sun et al. ..... 451/456
7,458,884 B2 * 12/2008 Falk ..... 451/359
7,549,913 B2 * 6/2009 Weiford et al. ..... 451/359
8,523,637 B2 * 9/2013 Loveless et al. ..... 451/359
2003/0013396 A1 * 1/2003 Sun et al. ..... 451/456
2005/0058518 A1 * 3/2005 Valentini ..... 409/134
2009/0017738 A1 * 1/2009 Fuchs et al. ..... 451/354
2013/0029571 A1 * 1/2013 Valentini ..... 451/456

FOREIGN PATENT DOCUMENTS

EP 1514644 3/2005
EP 2202029 6/2010
EP 2202029 A2 * 6/2010 ..... B24B 7/18

OTHER PUBLICATIONS

EP 2202029 (Jun. 2010) English Translation.*

* cited by examiner

*Primary Examiner* — Joseph J Hail
*Assistant Examiner* — Brian Keller
(74) *Attorney, Agent, or Firm* — Jacobson Holman, PLLC.

(57) ABSTRACT

A plate for machining surfaces is provided, comprising a body with bores and channels for aspirating dust, on the top of which a deflector is hooked. Said deflector includes at least one vertical curved wall adapted to define a double suction chamber consisting of a peripheral chamber and of a central chamber.

8 Claims, 6 Drawing Sheets

DOUBLE SUCTION CHAMBER PLATE

This application claims the priority of Italian no. MI2011A001434 filed Jul. 29, 2011, hereby incorporated by reference.

The present invention relates to a double suction chamber plate.

European Patent application EP-1514644-A1 by the Applicant describes a circular shaped plate for machining surfaces, comprising a flexible, perforated body made of polyurethane foam, in which a rigid support is sunk. Said plate is further provided with bores and cavities, and is placed in rotational or roto-orbital motion, in relation to the frame of the portable tool that supports it, by a mechanism which forms part of the portable tool itself, and is connected to a suitably shaped central pin, fastened to said rigid support. A thin layer of perforated Velcro covers the lower surface of the plate, allowing the adhesion of a sheet of abrasive material intended to cooperate with the surface to be machined.

The external edge of said rigid support is shaped so that a deflector on which a cap rests can be snap-fitted, the cap equipping the portable tool, in order to contain and convey the dust drawn therein through said bores and cavities towards a suction tube.

During the step of machining, the plate moves with rotational or roto-orbital motion relative to the frame of the tool to which it is linked, and the dust produced by the cooperation of the abrasive sheet with the surface to be machined is removed by means of a suction system. The dust particles pass through said bores and cavities and reach the upper part of the plate to then continue within the suction tube conveyed firstly by the deflector and then by the suction cap. The suction flow forces the dust to go towards the center of the plate, from where it can ascend towards the suction tube, possible side leakages being stopped by the presence of the junction cap and by the direction of the suction flow.

The use of a deflector constructionally allows to perforate the body of the plate at will, and accordingly to create any bore layout (in terms of diameter, number and arrangement of the bores themselves) specifically structured to limit the loss of machining dust into the surrounding environment and to increase the aspirated air flow (or other types of customizations even for commercial purposes). Furthermore, the aforesaid deflector "guides" the dust towards the suction tube without overstressing the junction cap which could be a precarious seal, and provides the cap itself with a better, smoother contact and sliding surface which improves tightness and reduces wear.

The plate with deflector described in said European patent application has the drawback of having a low suction power in the most peripheral zone, spaced apart from the central suction zone. Therefore, the dust particles which cross the most peripheral bores of the plate may be deposited over the plate body or under the deflector in the most peripheral part thereof, where the suction power is much lower and not sufficient to remove them.

It is the object of the present invention to provide a plate with deflector which improves the suction of dust at the peripheral zones of the plate, identified at the suction bores located at a greater distance from the center of the plate itself.

In accordance with the invention, such an object is achieved by a plate for machining surfaces that comprises a body with bores and channels for dust suction on which a deflector is hooked on the top, characterized in that said deflector comprises at least one curved vertical wall adapted to define a double suction chamber formed by a central chamber and by a peripheral chamber.

These and other features of the present invention will be further explained in the following detailed description of a practical embodiment shown by way of non-limiting example in the accompanying drawings, in which.

Figure 1:
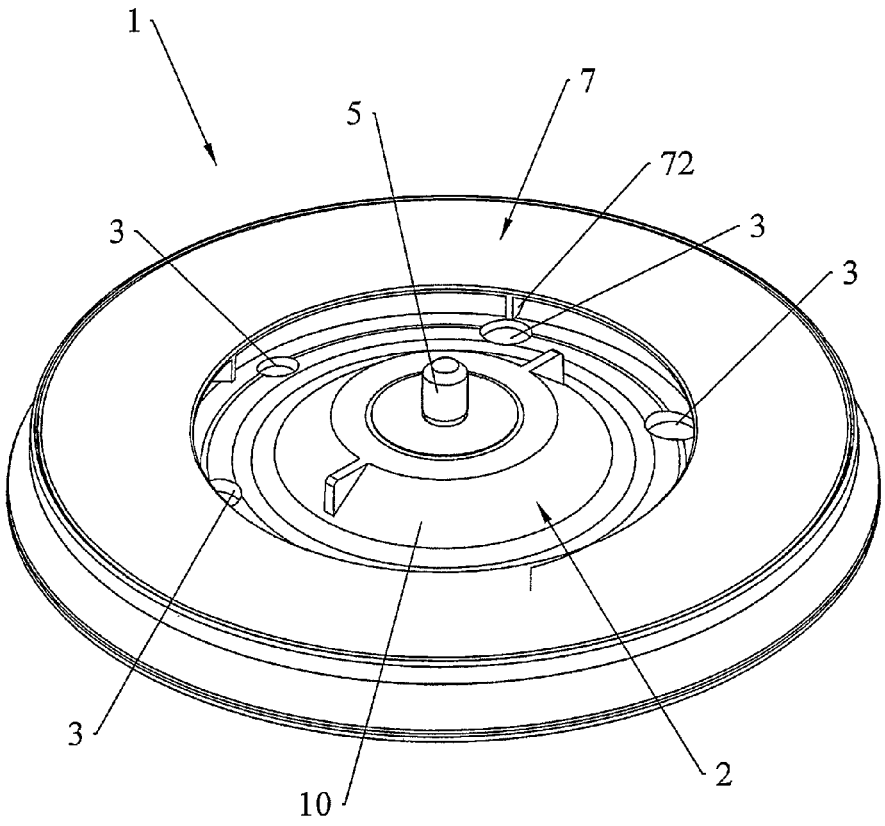
FIG. 1 is a top perspective view of a plate with deflector according to a first embodiment of the invention.

A portable machine tool for machining surfaces includes a circular shaped plate 1 comprising a body 2 consisting of a rigid support 10 made of thermoplastic material, preferably nylon, and a flexible perforated body 11, preferably made of polyurethane foam, wherein said rigid support 10 is sunk. Said plate 1 is also provided with bores 3 and cavities 4, and is placed in rotational or roto-orbital motion, relative to the frame of the portable tool that supports it, by a mechanism (not shown in the figures) that forms part of a portable tool and is connected to a suitably shaped central pin 5, fastened to the rigid support 10.

A thin layer of perforated Velcro 6 (or other suitable material) covers the lower surface of the plate 1, allowing the adhesion of a sheet of abrasive material intended to cooperate with the surface to be machined.

A circular deflector 7, on which a cap 9 (FIG. 2) rests, is snap-fitted over the body 2 of the plate 1 (FIGS. 1-4), the cap equipping the portable tool in order to contain and convey the dust drawn therein through the bores 3 and the cavities 4 towards a suction tube. Further suction bores 31 are provided, which are referred to as "peripheral" bores because they are arranged at a greater distance from the center of the plate 1.

Figure 3:
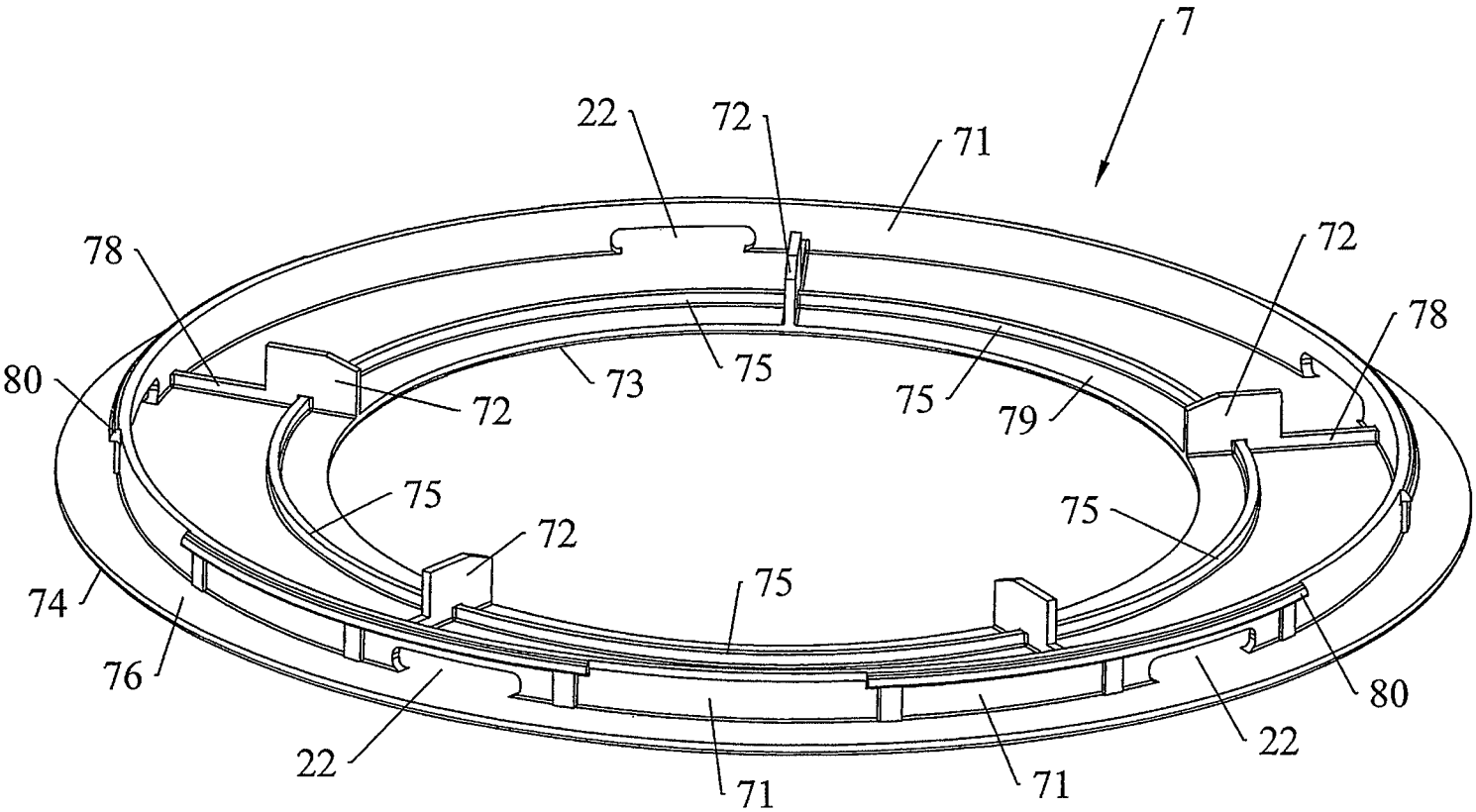
FIG. 3 is a bottom perspective view of the deflector for a plate in FIG. 1.
Figure 4:
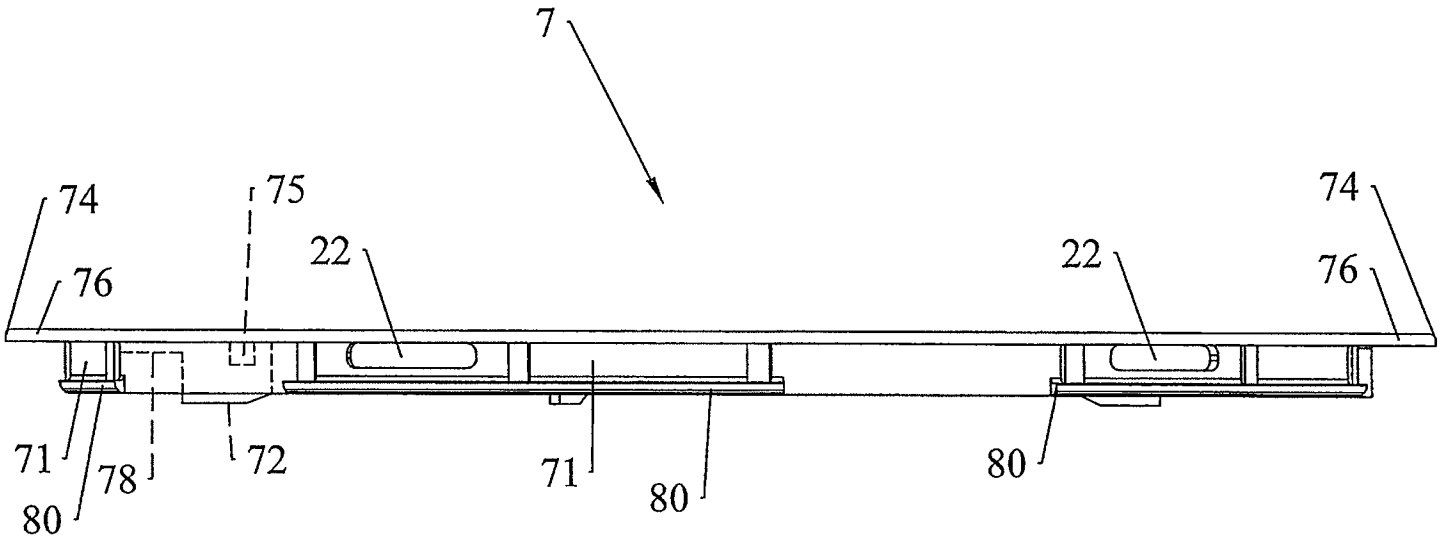
FIG. 4 is a side view of the deflector in FIG. 3.
Figure 5:
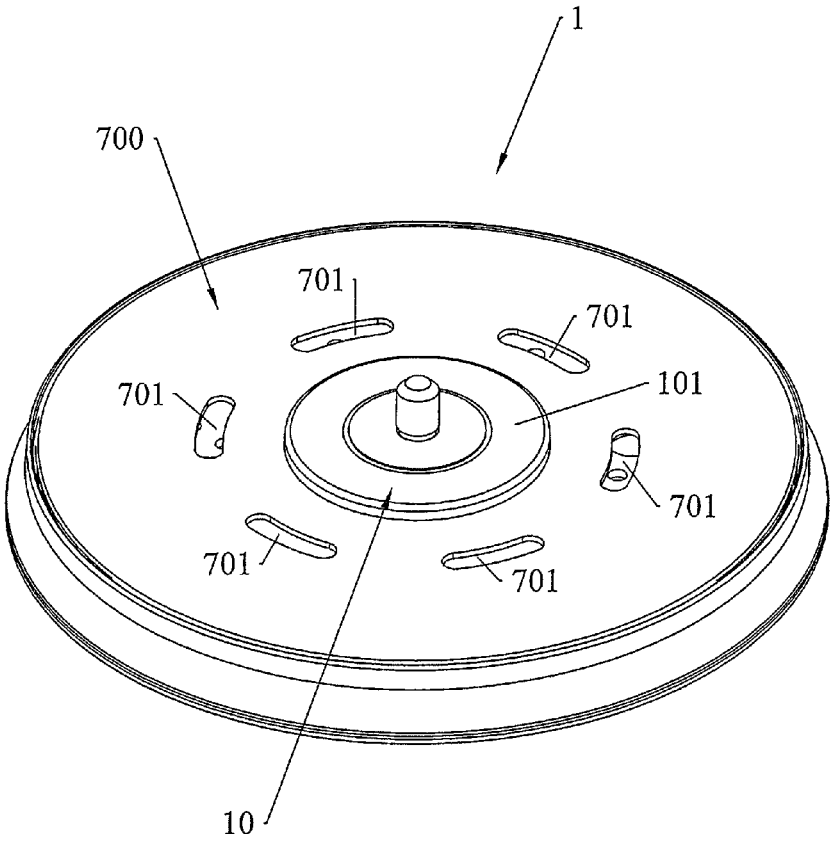
FIG. 5 is a top perspective view of a plate with deflector according to an alternative embodiment of the invention.
Figure 7:
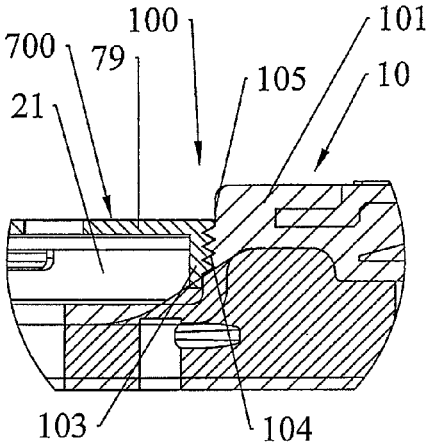
FIG. 7 is an enlargement of round B in FIG. 6.
Figure 8:
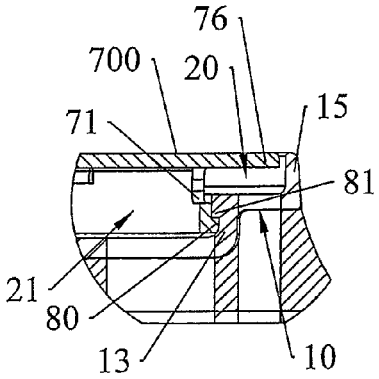
FIG. 8 is an enlargement of round C in FIG. 6.
Figure 6:
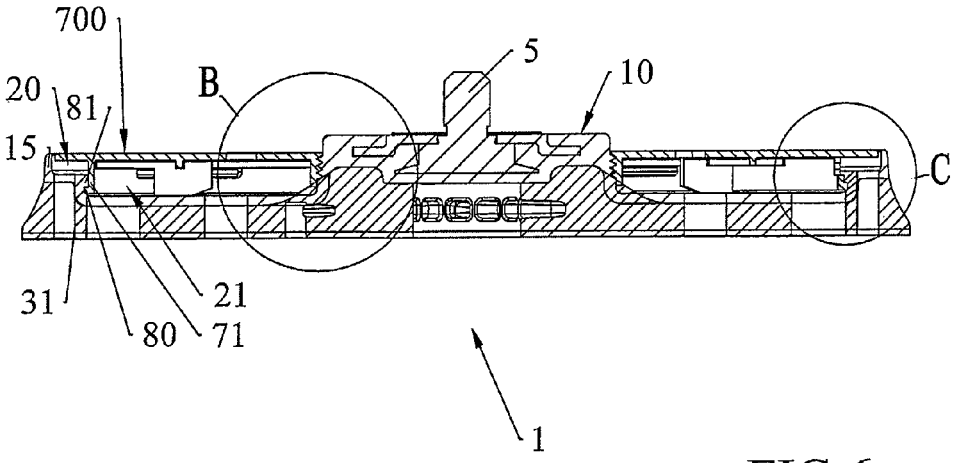
FIG. 6 is a vertical axial section view of the plate in FIG. 5.

The deflector 7, clearly seen in FIGS. 3 and 4, is hooked by snapping onto the rigid support 10 by means of a curved vertical wall 71 (possibly split into several sectors), which couples to an inner curved edge 13 of the rigid support 10. The fastening occurs by coupling the end teeth 80 of the wall 71 and 81 of the edge 13 of the rigid support 10.

The walls 71 and the edge 13 have the same curvature radius as the circular plate 1.

The deflector 7 further includes a flat outer portion 76 with outer edge 74, and a flat inner portion 79 with inner edge 73.

Ribs 78 which end with flat portions 71 laying on a radial plane which reach the inner edge 73 of the deflector 7 radially depart from the vertical wall 71. The outer edge 74 of the deflector 7 is adjacent to a curved outer edge 15 of the body 2. Said flat portions 72 allow to more effectively address the dust towards the center of the plate 1, thus facilitating its suction.

There is provided an inner annular rib 75 which connects said flat portions 72 increasing its rigidity.

The coupling between the deflector 7 and support 10 determines the formation of a double suction chamber consisting of a peripheral chamber 20, into which the dust flows from the peripheral bores 31 of the plate 1, and of a central chamber 21, into which the dust flows from the bores 3.

Figure 2:
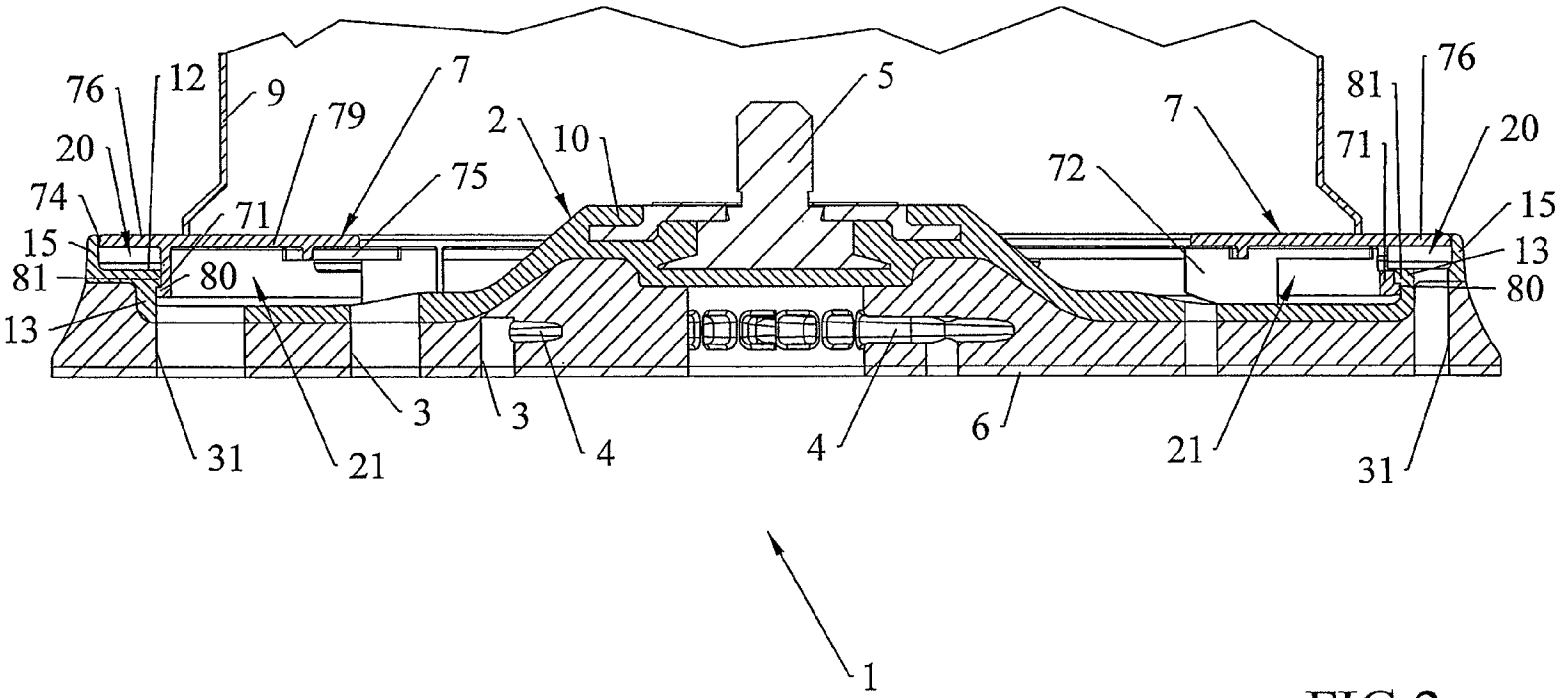
FIG. 2 is a vertical axial section view of the plate in FIG. 1 with a cap.

The peripheral suction chamber 20 is defined, as clearly shown in FIG. 2, by approaching the wall 71 and the flat outer portion 76 of deflector 7 to the plane 13 and the outer edge 15 of the rigid support 10.

The central suction chamber 21 is open inwards and delimited by the wall 71 and by the inner flat portion 79 of deflector 7, and by the support 10. The dust from the bores 3 and from the peripheral chamber 20 is conveyed into said chamber 21 by means of openings 22 obtained in the wall 71 (FIGS. 3 and 4).

FIGS. 5-8 show a second embodiment of plate 1 (the same numerals being used for similar parts), where a deflector 700 is hooked to the rigid support 10 of the plate by means of a connection (a screw connection 100, by way of non-limiting example) at a central part 101 of the support 10 near pin 5. FIGS. 5-8 describe, by way of non-limiting example, a fastening system of the deflector characterized by a nut screw 102 of a central annular mouth 103 of the deflector 700 which is screwed onto a screw 104 obtained onto an annular edge 105 of the central part 101 of the rigid support 10.

The deflector 700 shown in FIGS. 5-8 is completely similar to the deflector 7 of FIGS. 1-4, except for the means and connection points with support 10, which are no longer fitted onto the outer diameter but onto an inner diameter of the same instead. Therefore, the curved vertical wall 71 has no coupling teeth 80, exactly like the curved inner edge 13 is not provided with coupling teeth 81. In the embodiment shown in FIGS. 5-8, the peripheral suction chamber 20 is defined by approaching the wall 71 and the flat outer portion 76 of the deflector 700 to the surface 13 and the outer edge 15 of the rigid support 10.

The deflector 700 completely covers the suction bores 3, 31 and has cracks 701 for the dust to pass from the suction chambers 20 and 21 to the space inside the cap 9.

The central suction chamber 21 is closed inwards and delimited by vertical curved wall 71, inner flat portion 79 of deflector 700, support 10 and central annular mouth 103. The dust coming from the bores 3, 31 is conveyed into said suction chambers 20 and 21, which communicate through the openings 22 of wall 71.

The generated dust is advantageously aspirated more efficiently in the most peripheral zone of the plate through the peripheral bores 31, then enters the peripheral chamber 20, through the openings 22 and enters the central chamber 21 to then be conveyed into the cap 9 and then towards the suction tube. Thereby, the lower surface of the plate effectively contributes, in addition to machining, also to aspirating the generated dust.

The curved walls 71 of the deflectors 7, 700 of the two described embodiments regulate the vacuum difference between the chambers 20 and 21 by means of the openings 22. Therefore, an increase in the particle speed in the more peripheral zone under the deflectors 7, 700, i.e. in the peripheral chambers 20, is found. Under normal conditions, such an increase in speed determines an increase in the depression with respect to the ambient values of the machined surface, and thus an increase in the suction power at the outer zone of the plate. The peripheral chambers 20 substantially accelerate the motion of the dust particles by aspirating them from the peripheral bores 31. The dust particles advantageously reach the central chambers 21 being accelerated through the spaces 22.

The combined effect of peripheral bores 31 and peripheral suction chambers 20 determines the possibility, by means of a different distribution of the bores, to obtain different configurations, privileging suction where it is most convenient according to the type of machining and the aspirated dust flow.

The invention claimed is:

1. A rotatable plate for machining surfaces, comprising a body with bores and channels for dust suction wherein a deflector is fastened to and above the rotatable plate, wherein said deflector comprises at least one curved vertical wall defining a double suction chamber formed by a peripheral suction chamber and by a central suction chamber, and wherein the deflector comprises a flat outer portion and a flat inner portion separated by the at least one curved vertical wall provided with openings, wherein said at least one curved vertical wall of the deflector is tightly fitted with a curved inner edge of the body through coupling teeth located on said at least one curved vertical wall of the deflector and the curved inner edge of the body, respectively.

2. The plate according to claim 1, wherein ribs ending with flat portions lying in a radial plane extend radially from a median zone of said at least one curved vertical wall of the deflector.

3. The plate according to claim 2, wherein an internal annular rib is provided for connecting said flat portions.

4. The plate according to claim 1, wherein said peripheral suction chamber is formed by abutment of said at least one curved vertical wall and said flat outer portion of the deflector with an outer edge and with the curved inner edge of the body.

5. The plate according to claim 1, wherein the central suction chamber is open towards inside and is delimited by said at least one curved vertical wall, by said flat inner portion of the deflector and by the body, in said central suction chamber being conveyed the dust coming from the bores and from the peripheral suction chamber through openings provided in said at least one curved vertical wall.

6. The plate according to claim 1, wherein the central suction chamber is closed towards inside and is delimited by said at least one curved vertical wall, by the flat inner portion of the deflector by the body, and by a central annular mouth, in said central suction chamber being conveyed the dust coming from the bores and from the peripheral suction chamber through openings provided in said at least one curved vertical wall.

7. The plate according to claim 1, wherein the deflector is provided with screw means for connection with the body.

8. The plate according to claim 7, wherein the deflector is provided with a central annular mouth with a screw nut which is screwed on a screw provided in an annular edge of a central part of the body.

* * * * *